US007654758B2

(12) United States Patent
Loh et al.

(10) Patent No.: US 7,654,758 B2
(45) Date of Patent: Feb. 2, 2010

(54) SYSTEMS AND METHODS FOR DETERMINING MEDIA SIZE

(75) Inventors: Beverly Loh, Vancouver, WA (US); Patrick W. Chewning, Beaverton, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 434 days.

(21) Appl. No.: 11/686,469

(22) Filed: Mar. 15, 2007

(65) Prior Publication Data

US 2008/0226372 A1 Sep. 18, 2008

(51) Int. Cl.
*B65H 43/08* (2006.01)
*B65H 43/00* (2006.01)
*B41J 13/00* (2006.01)

(52) U.S. Cl. ..... 400/76; 400/582; 400/578

(58) Field of Classification Search ..... None
See application file for complete search history.

(56) References Cited

U.S. PATENT DOCUMENTS 5,311,259 A 5/1994 Moriya
5,619,240 A 4/1997 Pong
6,185,402 B1 2/2001 Linssen
6,614,553 B2 9/2003 Nakami
6,836,627 B2 * 12/2004 Kretschmann et al. ..... 399/82
2005/0219590 A1 * 10/2005 Andersen et al. ..... 358/1.12
2007/0025788 A1 * 2/2007 deJong et al. ..... 399/388

FOREIGN PATENT DOCUMENTS

JP 09204078 A * 8/1997
JP 09222837 A * 8/1997
JP 2004163545 A * 6/2004

OTHER PUBLICATIONS

International Search Report in co-pending PCT Application No. PCT/US2008/054842.

* cited by examiner

*Primary Examiner*—Daniel J Colilla

(57) ABSTRACT

In one embodiment, a system and method pertain to measuring the length of media using a first sensing system of the printing device to obtain a first length value, measuring the length of the media using a second sensing system of the printing device to obtain a second length value, and calculating a scale factor that can be applied to measurements made by the first sensing system to increase the accuracy of those measurements, wherein the scale factor is calculated relative to the first and second length values.

25 Claims, 5 Drawing Sheets

SYSTEMS AND METHODS FOR DETERMINING MEDIA SIZE

BACKGROUND

It is often desirable to determine the size of media that is input into a printing device, for example to ensure that the printing device can process the media, to identify mismatch between a size identified by the user and that detected by the printing device, to control the manner in which print images are applied to the media. In many printing devices, the length of the media is measured near the beginning of the media path using an encoder that counts the number of whole and fractional revolutions of a drive roller within the printing device that drives the media along the device's media path. For instance, once a leading edge of a sheet of media is detected, the number of revolutions through which the drive roller rotates until a trailing edge of the sheet is detected is counted. Given that the circumference or diameter of the drive roller is presumed known, the length of the sheet can be determined from the number of revolutions.

Many printing device drive rollers are made of materials that wear during use. For example, such drive rollers may comprise a rubber outer layer that grips the media to avoid slippage of the media along the media path. In such cases, the size of the drive roller may change over time. Specifically, the circumference and diameter of the drive roller can become smaller over time. Because the media length determination is made relative to a presumed roller circumference or diameter, changes in actual roller circumference or diameter can lead to inaccurate media length determinations. Although such inaccuracy may be relatively small in an absolute sense, it is important to identify the length of the media with high precision since several different sizes of media having similar lengths may be used with the printing device and must be distinguished from each other.

BRIEF DESCRIPTION OF THE DRAWINGS

The disclosed systems and methods can be better understood with reference to the following drawings. The components in the drawings are not necessarily to scale.

DETAILED DESCRIPTION

As described above, the size of printing device drive rollers used in determining the length of media can change over time. Because the media size determination is made relative to a presumed roller dimension, changes in actual roller dimensions can lead to inaccurate media size determinations. As described in the following, such inaccuracy can be reduced or eliminated by calibrating the printing device to account for the effects of drive roller size variation when determining media size.

In some embodiments, the lengths of print media input into the media path are intermittently measured at preset intervals with a highly accurate sensing system normally used to detect the position of the media on a print surface of the printing device. The lengths measured with the second sensing system are then related with lengths measured by the sensing system associated with the drive roller and normally used to determine media size. In particular, those lengths are used to generate a correction or scale factor that can be used to adjust measurements made by the drive roller sensing system to thereby take into account changes in roller size.

Disclosed herein are embodiments of systems and methods for determining media size. Although particular embodiments are disclosed, those embodiments are provided for purposes of example only to facilitate description of the disclosed systems and methods. Therefore, the disclosed embodiments are not intended to limit the scope of this disclosure.

Figure 1:
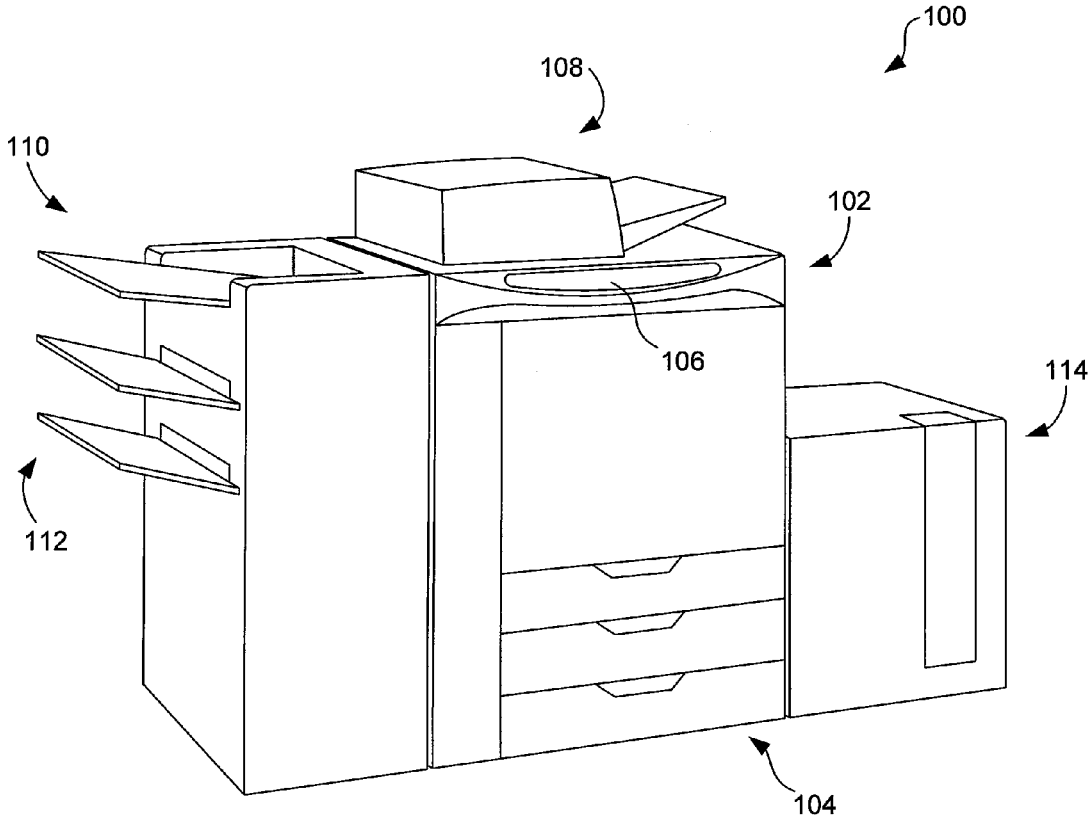
FIG. 1 is a perspective view of an embodiment of a printing device configured to determine media size.

Referring now in more detail to the drawings, in which like numerals indicate corresponding parts throughout the several views, FIG. 1 illustrates an embodiment of a printing device 100. By way of example, the printing device 100 comprises an inkjet printer. Although an "inkjet" printer has been specifically mentioned, it is noted that the printing device 100 could comprise another form of printing device, such as a laser printer. Moreover, although a "printer" has been specifically mentioned, it is noted that the printing device 100 need not be limited to printing functionality alone. For example, in some embodiments, the printing device 100 can provide further functionalities such as copying, faxing, and emailing. In such a case, the printing device 100 may be described as a multi-functional printing device.

As indicated in FIG. 1, the printing device 100 comprises a main printing unit 102 that contains the various internal components of the print mechanism. As described below, those components can comprise one or more inkjet pens configured to eject droplets of ink on a suitable print medium, such as paper. As further indicated in FIG. 1, the main printing unit 102 includes one or more media input trays 104 in which sheets of print media can be loaded. In addition, the printing unit 102 comprises a control panel 106 with which a user can interface to enter various selections that control operation of the printing device 100. Optionally, the print unit 102 further comprises an automatic document feeder 108 with which sheets of media can be automatically positioned on a platen (not shown) of the printing device 100 to enable copying of images provided on that media.

In the embodiment of FIG. 1, the printing device 100 further includes a media output device 110 that comprises one or more media output trays 112 in which printed media can be output from the printing device. In addition, the printing device 100 of FIG. 1 includes a high-capacity media input device 114 that, like the media trays 104, can store media to be input into a media path of the printing device.

Figure 2:
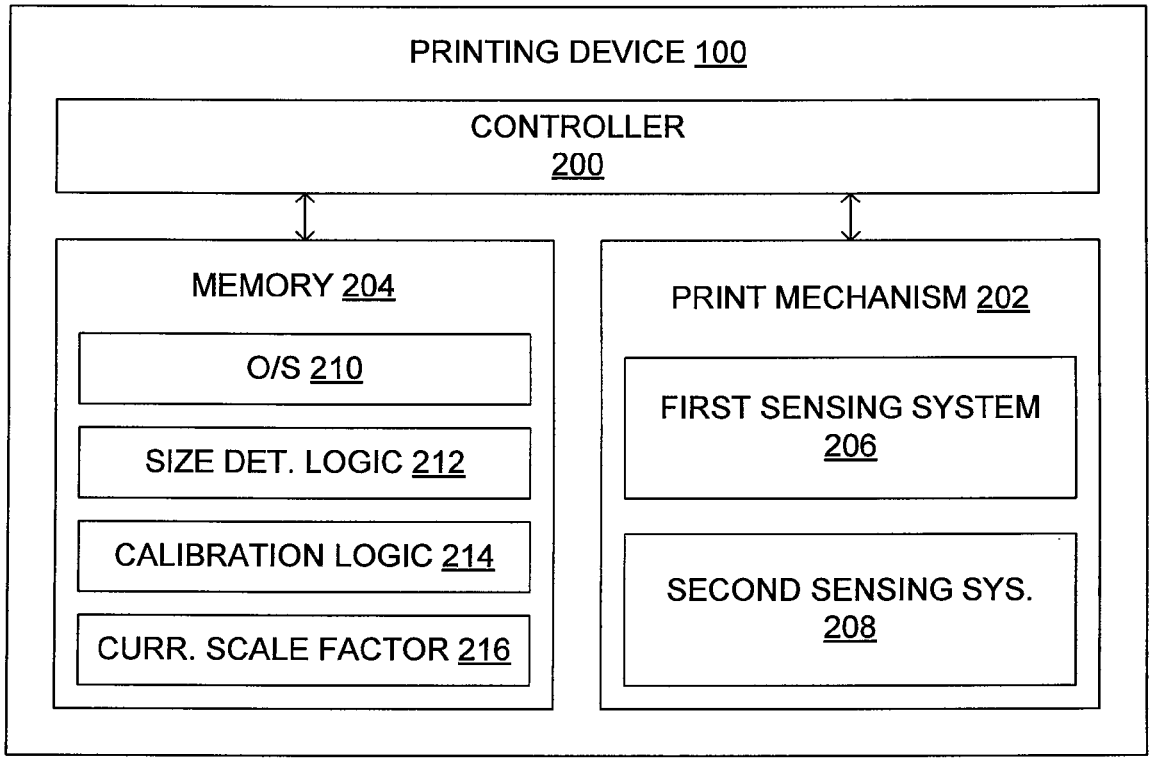
FIG. 2 is a block diagram of an embodiment of the printing device of FIG. 1.

FIG. 2 is a block diagram illustrating an example architecture for the printing device 100 of FIG. 1. As is indicated in FIG. 2, the printing device 100 comprises a controller 200, a print mechanism 202, and memory 204. The controller 200 is adapted to execute commands that control operation of the printing device 100 and can, for example, comprise one or more processors and/or application-specific integrated circuits (ASICs).

As described above, the print mechanism 202 includes various components that are used to perform printing, including, for example, drive motors and associated transmissions, drive rollers, a print surface, and inkjet pens. As shown in FIG. 2, the print mechanism 202 further includes first and second sensing systems 206 and 208 that are used to determine media size. Examples for the first and second sensing systems 206, 208 are described in relation to FIG. 3.

The memory 204 comprises any one or a combination of volatile memory elements (e.g., random access memory (RAM)) and nonvolatile memory elements (e.g., read-only memory (ROM), Flash memory, hard disk, etc.). The memory 204 stores various programs and other logic including an operating system (O/S) 210 that comprises the commands used to control general operation of the printing device 100. In addition, the memory 204 stores media size determination logic 212 that is used to determine the size of media input into the printing device media path. In at least some embodiments, the first sensing system 206 is used to determine media length relative to revolutions of a drive roller of the printing device 100. The memory 204 further stores calibration logic 214 that is used to calculate a correction or scale factor, that is used to adjust media length measurements made by the first sensing system 206. In at least some embodiments, the calibration logic 214 generates the scale factor relative to media length measurements made by the second sensing system 208. Once calculated by the calibration logic 214, the scale factor can be stored in memory 204, for example nonvolatile memory, as the current scale factor 216. The current scale factor 216 is then used by the size determination logic 212 in determining media size to account for changes in drive roller size.

Various programs (logic) have been described herein. Those programs can be stored on any computer-readable medium for use by or in connection with any computer-related system or method. In the context of this document, a "computer-readable medium" is an electronic, magnetic, optical, or other physical device or means that contains or stores a computer program for use by or in connection with a computer-related system or method. Those programs can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

Figure 3:
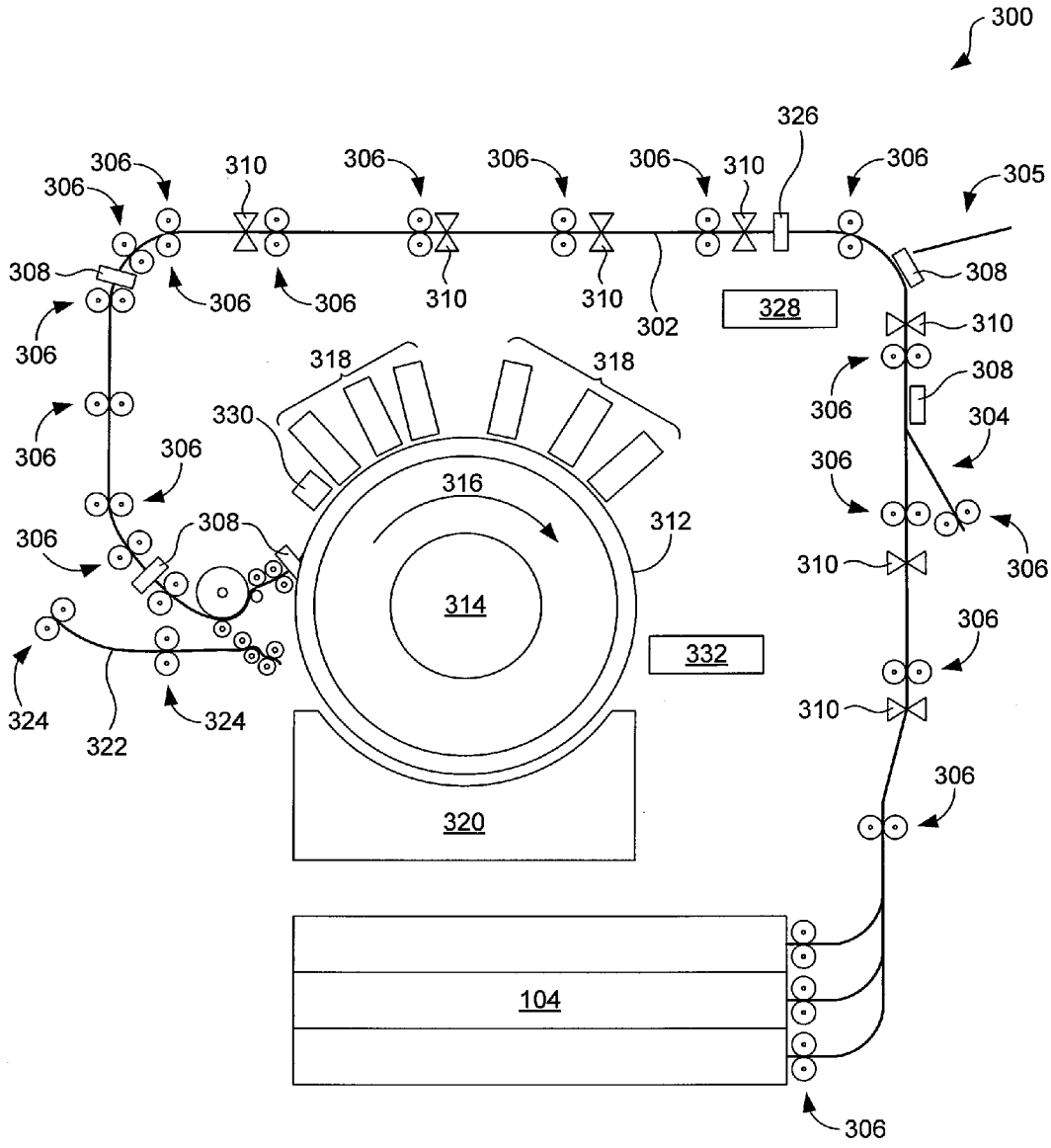
FIG. 3 is schematic view of an embodiment of a print mechanism of the printing device of FIG. 1.

FIG. 3 schematically illustrates an example print mechanism 300 for the printing device 100 of FIG. 1. The print mechanism 300 comprises a media path along which media traverses within the printing device 100. Included in the media path is a print path 302 along which media traverses to reach a print surface described below. In some cases, media can be input into the print path 302 from the input trays 104 first described in relation to FIG. 1. In other cases, media can be input into the print path 302 at a high-capacity input area 304 associated with the high-capacity input tray 114 also shown in FIG. 1. In still other cases, media can be input into the print path 302 at a bypass input area 305 associated with a bypass tray of the printing device 100 (not shown).

Irrespective of how media is input into the print path 302, the media is driven along the path by a plurality of drive rollers 306, which are driven by motors and associated transmissions (not shown) of the print mechanism 100. Positioned at various locations along the print path 302 are sensors that detect the presence, or absence, of media. For example, various optical sensors 308 are provided as are various mechanical sensors 310.

During operation, sheets of print media are driven along the print path 302 toward a print surface 312. In the embodiment of FIG. 3, the print surface 312 is the outer surface of a metal print drum 314 that is rotated by an associated drive motor and transmission (not shown) in the direction indicated by arrow 316. The print surface 312 of the drum 314 can be divided into multiple drum zones with which the sheets of media can be coordinated. Specifically, the leading edges of the media sheets can be aligned with the leading edges of particular drum zones during printing to precisely align the media with media hold-down features of the drum 314 as well as to enable removal of the media from the drum after printing has been completed. In some embodiments, the hold-down features include perforations that are used to apply a vacuum to the media to hold the media in place on the print surface 312.

Once the print media reaches the drum 314, the media is loaded on the print surface 312 in alignment with a given drum zone. The media then rotates with the drum 314 in the direction of arrow 316 so that it passes under inkjet pens 318 that are used to eject droplets of ink onto the media. That ink is dried on the media using a dryer 320 that comprises one or more internal heating elements and one or more fans (not shown) that blow hot air over the media as it passes the dryer on the drum 314. After printing and drying have been completed, the media is removed from the drum 314 and is output from the printing device 100 along an output path 322 that comprises its own drive rollers 324.

In the embodiment of FIG. 3, the first sensing system identified in relation to FIG. 2 comprises an optical sensor 326 and an encoder 328 that are used together in association with at least one of the drive rollers 306. The optical sensor 326 detects the leading and trailing edges of media being driven by the drive roller 326. By way of example, the optical sensor 326 is a transmissive optical sensor that comprises a light source and a light detector. The light source shines light toward the print path 302 and that light is then detected by the light detector, assuming the light is not obstructed by a sheet of media. Therefore, the optical sensor 326 can determine when the media arrives at and passes a predetermined position along the print path 302. The encoder 328 counts revolutions, either of the drive roller 306 or the motor or transmission used to drive the roller. Therefore, the encoder 328 can be used to determine the number of revolutions through which the drive roller 306 rotates between detection of the leading edge of the media and the trailing edge of the media. Through knowledge of the size (e.g., circumference) of the drive roller 306, the length of the media can be calculated.

In the embodiment of FIG. 3, the second sensing system identified in relation to FIG. 2 comprises a second optical sensor 330 and a second encoder 332 that are used together in association with the print drum 314. The optical sensor 330 detects the leading and trailing edges of media applied to the print surface 312 of the drum 314. By way of example, the optical sensor 330 is a reflective optical sensor that also comprises a light source and a light detector. The light source shines light toward the drum 314 that is reflected off of the drum and is detected by the light detector, assuming the light is not absorbed by a sheet of media. Therefore, the optical sensor 330 can determine when the media arrives at and passes the optical sensor. The encoder 332 counts revolutions of the drum 314 or the motor or transmission used to drive the drum. Therefore, the encoder 332 can determine the number of revolutions through which the drum 314 rotates between detection of the leading edge of the media and the trailing edge of the media. Through knowledge of the size (e.g., circumference) of the drum 314, the length of the media can be calculated.

In at least some embodiments, the optical sensor 330 and encoder 332 of the second sensing system are high-precision instruments that can be used to measure the length of media with great accuracy. Given that the drum 314 is constructed from a metal material that does not significantly wear during its usable life, the accuracy of that measurement does not significantly change over the useful life of the drum.

Example systems having been described above, operation of the systems will now be discussed. In the discussions that follow, flow diagrams are provided. Process steps or blocks in these flow diagrams may represent modules, segments, or portions of code that include one or more executable instructions for implementing specific logical functions or steps in the process. Although particular example process steps are described, alternative implementations are feasible. Moreover, steps may be executed out of order from that shown or discussed, including substantially concurrently or in reverse order, depending on the functionality involved.

Figure 4:
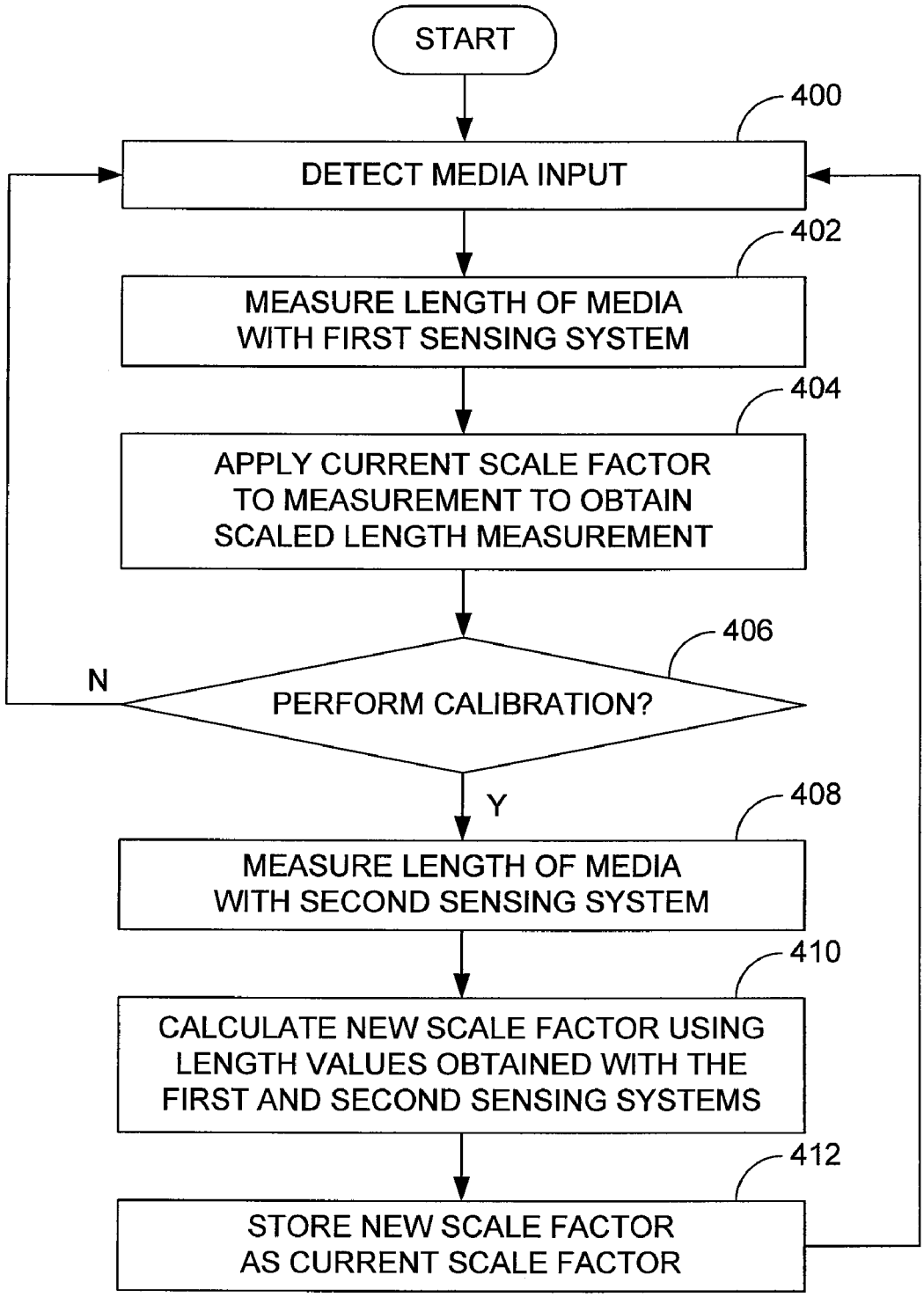
FIG. 4 is a flow diagram of an embodiment of a method for determining size of media using a printing device.

FIG. 4 illustrates an example method for determining media size with a printing device. Beginning with block 400, media input into the media path of the printing device is detected, for example using one or more of optical and mechanical sensors. The length of the media is then measured using a first sensing system, as indicated in block 402. As described in relation to FIG. 3, the first sensing system can be associated with a drive roller positioned along the print path and can comprise an optical sensor that detects the leading and trailing edges of the media and an encoder that counts revolutions of the drive roller between detection of the leading and trailing edges. Notably, the encoder need not directly count the revolutions of the roller. Instead, the encoder can count the number of revolutions of the motor and/or transmission that drives the drive roller. Given the mechanical coupling between the motor and/or transmission and the drive roller, however, the number of revolutions of the drive roller can be determined. By way of example, the size determination logic 212 (FIG. 2) makes that determination.

Turning to block 404, a current scale factor is applied to the measurement obtained using the first sensing system to account for changes in roller size, for example due to roller wear. The current scale factor can be so applied by the size determination logic 212 (FIG. 2). By way of example, the size determination logic 212 multiples the measurement from the first sensing system by the current scale factor. The current scale factor can have been previously calculated by the measurement from the first sensing system during a previous calibration procedure. If calibration has yet to be performed, however, for instance if the printing device is new and no calibration was performed prior to shipping, the scale factor may be set to an initial default value, such as 1.0. In such a case, the drive roller is presumed to have a nominal or "as designed" size. Regardless, if the scale factor is other than the initial default value, application of the scale factor will adjust the measurement to produce a scaled length measurement that takes changes in drive roller size into account.

Flow from this point depends upon whether calibration is to be performed. With reference to decision block 406, if calibration is not to be performed, the scaled length measurement is used by the printing device for processing a print job, and the next sheet of media is detected and measured. If, on the other hand, calibration is to be performed, flow continues on to block 408. As described above, calibration can be performed at predetermined intervals. Given that drive roller wear typically results from use associated with driving media, it makes sense to perform calibration after a given number of sheets have been processed by the printing device. By way of example, calibration can be performed at intervals of 25,000 to 75,000 sheets, for instance each time 50,000 sheets have been printed. Assuming a 50,000 sheet interval, calibration will be performed after the first 50,000 sheets have been printed, after 100,000 sheets have printed, after 150,000 sheets have been printed, and so forth. Notably, calibration can be performed automatically by the printing device when the threshold number of sheets has been reached without prompting by the user. Of course, calibration can in some embodiments, be performed on command by the user.

If calibration is to be performed, the length of the media is also measured by the second sensing system, as indicated in block 408. As described above, the second sensing system can comprise a high-precision sensing system associated with the print drum. Again, the second sensing system can comprise an optical sensor that detects the leading and trailing edges of the media and an encoder that counts revolutions of the drum, either directly or indirectly. Although the second sensing system could always be used to measure the media length, it is still desirable to measure the media length earlier along the print path. For that reason, the first sensing system, which is positioned at a point upstream from the second sensing system, is relied upon for determining media length.

Once the media length has been measured by the second sensing system, that length can be used along with the scaled length measurement obtained using the first sensing system to calculate a new scale factor, as indicated in block 410. By way of example, the new scale factor is calculated by the calibration logic 214 (FIG. 2). The new scale factor can then be stored as the current scale factor, as indicated in block 412. As described below, the scale factor comprises a number that, when applied to lengths measured by the first sensing system, produces length values that more closely correspond with lengths that would be measured by the more accurate second sensing system and therefore are closer to the actual lengths of the media.

Figure 5:
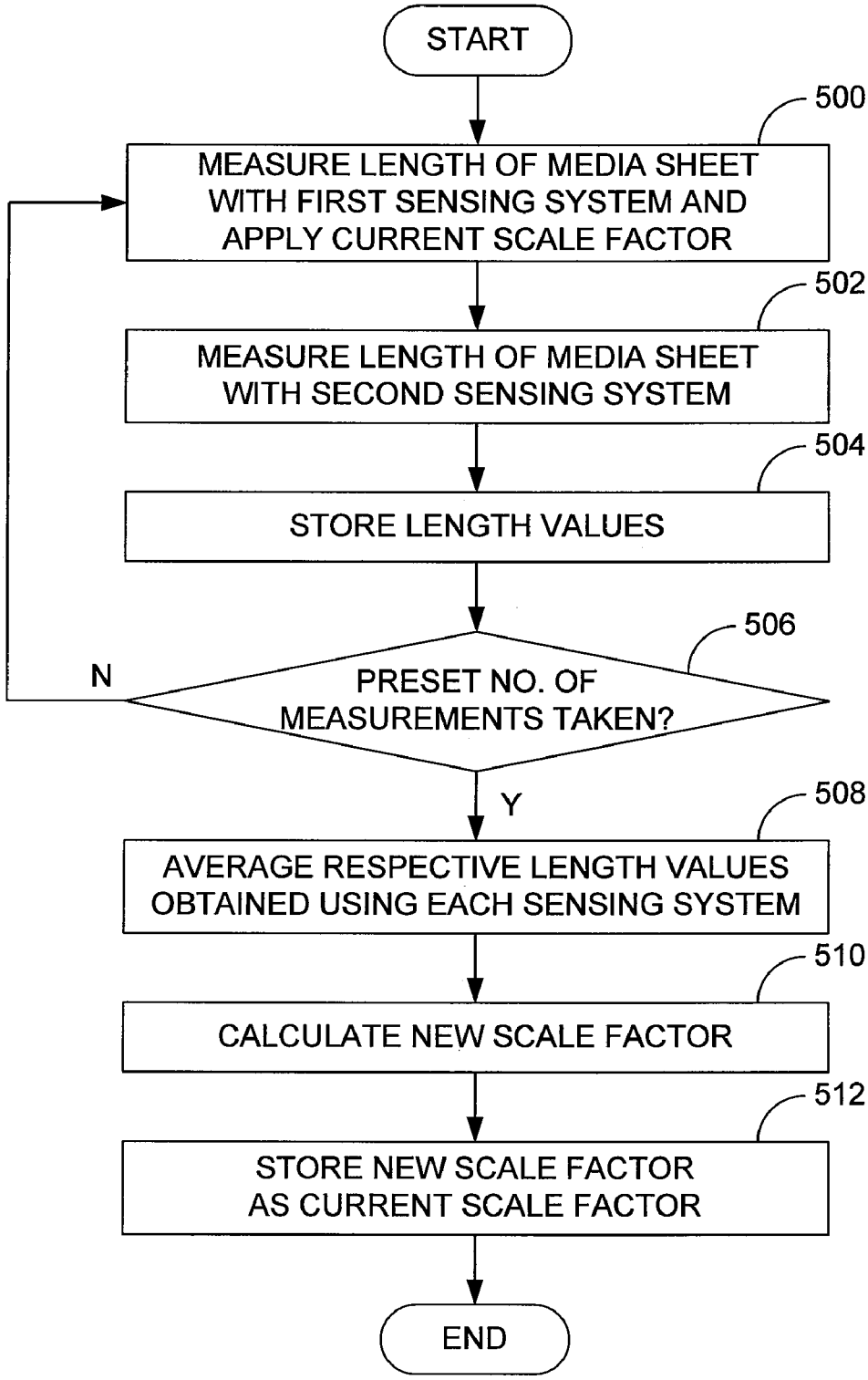
FIG. 5 is a flow diagram of an embodiment of a method for calibrating a printing device.

FIG. 5 illustrates an example method for calibrating a printing device. Beginning with block 500, the length of a sheet of media is measured with the first sensing system and adjusted through application of the current scale factor. Again, the current scale factor can comprise a previously calculated scale factor, or an initial default value if a calibration has not yet been performed on the printing device. Turning to block 502, the length of the media sheet is also measured by the second sensing system. Next, the length values are stored, as indicated in block 504.

With reference to decision block 506, flow from this point depends upon whether a preset number of measurements have been taken. Where the preset number is greater than one, multiple measurements are used to calculate a new scale factor. In some embodiments, 10 to 30 sheets can be measured by each of the sensing systems during the calibration process. For example, measurements of 20 different sheets can be taken by each of the first and second sensing systems. Notably, the sheets measured during the calibration process can be sheets that form part or the entirety of one or more print jobs being printed by the printing device during normal operation. Accordingly, the calibration process need not be performed separate from, and therefore need not delay, normal use of the printing device.

If the preset number of measurements (sheets) has not yet been reached, flow returns to block 500 and further measurements are taken. Once all of the measurements have been obtained, however, flow continues to block 508 at which the stored length values obtained using each respective sensing system are separately averaged. For example, if 20 sheets were measured, the 20 length values obtained using the first sensing system (i.e., the scaled length measurements) are averaged, and the 20 length values obtained using the second sensing system are likewise averaged. Next, a new scale factor can be calculated, as indicated in block 510. In at least some embodiments, the new scale factor is calculated using the following relation:

$$\text{New Scale Factor} = \frac{AL_2}{AL_1} \times SF_{current} \quad \text{[Equation 1]}$$

where $AL_1$ is the average of the length values obtained using the first sensing system, $AL_2$ is the average of the length values obtained using the second sensing system, and $SF_{current}$ is the current scale factor. Therefore, by way of example, if the average length measured using the first sensing system is approximately 298 millimeters (mm), the average length measure using the second sensing system is 292 mm, a length ratio of 0.98 (i.e., 292/298) results. Assuming that the current scale factor is 1.0, the new scale factor is 0.98. In such a case, the average measurement obtained by the first sensing system are 2% off, i.e., 2% larger, than the average measurements obtained by the second sensing system. Such a difference may be due to decreased driver roller circumference, which translates into a greater number of roller revolutions between the leading and trailing edges of the media. Because the first sensing system indicates a media length that is 2% larger than the actual length of the media (as measured by the second sensing system), later measurements obtained by the first sensing system should be decreased by 2% to obtain a more accurate length measurement from the first sensing system.

Once the new scale factor has been calculated, it can then be stored as the current scale factor, as indicated in block 512, so that it will be available for scaling other lengths measured by the first sensing system, i.e., the sensing system used in association with the drive roller.

The next time calibration is performed, for example in another 50,000 sheets, the scale factor that was stored in block 512 is used in Equation 1 to calculate another new scale factor. Therefore, assuming that the average length measured using the first sensing system during the new calibration is 295 mm and the average length measured using the second sensing system during that calibration is 292 mm, the new scale factor is (292/295)(0.98), or 0.97.

Using calibration of the type described in the foregoing, variations in the printing device that occur over time are taken into consideration when making media size determinations. As a result, media size can more accurately be identified by the printing device, thereby ensuring consistent results over the lifetime of the printing device.

It is noted that, the current scale factor can be reset at any time. Such resetting may be appropriate when the drive roller associated with the first sensing system is replaced. In such a situation, the current scale factor may be reset to 1.0.

The invention claimed is:

1. A method performed by a printing device, the method comprising:

measuring the length of a sheet of media using a first sensing system of the printing device to obtain a first length value;

measuring the length of the sheet of media using a second sensing system of the printing device to obtain a second length value, the second sensing system being more accurate than the first sensing system;

identifying error in the first sensing system from comparison of the first length value and the second length value and calculating a scale factor that can be applied to measurements made by the first sensing system to compensate for the error, wherein the scale factor is calculated relative to the first and second length values; and applying the scale factor to later measurements made by the first sensing system in relation to other sheets of media to improve the accuracy of those measurements.

2. The method of claim 1, wherein measuring the length of the sheet of media using the first sensing system comprises measuring the length of the sheet of media using a sensing system associated with a drive roller of the printing device.

3. The method of claim 2, wherein the sensing system associated with the drive roller comprises an optical sensor used to detect leading and trailing edges of media driven by the roller and an encoder used to determine a number of revolutions of the roller that occur between detection of the leading and trailing edges.

4. The method of claim 1, wherein measuring the length of the sheet of media using the second sensing system comprises measuring the length of the sheet of media using a sensing system associated with a print drum of the printing device.

5. The method of claim 4, wherein the sensing system associated with the print drum comprises an optical sensor used to detect leading and trailing edges of media loaded onto the print drum and an encoder used to determine a number of revolutions of the print drum that occur between detection of the leading and trailing edges.

6. The method of claim 1, further comprising measuring the lengths of a preset number of sheets of media using the first sensing system to obtain multiple first length values.

7. The method of claim 6, further comprising measuring the lengths of the preset number of sheets of media using the second sensing system to obtain multiple second length values.

8. The method of claim 7, wherein calculating a scale factor comprises separately averaging the first length values and the second length values to obtain a first average length value and a second average length value.

9. The method of claim 8, wherein calculating a scale factor further comprises dividing the second average length value by the first average length value to obtain a length ratio.

10. The method of claim 9, further comprising multiplying the first length values by a current scale factor prior to averaging the first length values and wherein calculating a scale factor further comprises multiplying the length ratio by the current scale factor to obtain a new scale factor.

11. The method of claim 10, further comprising multiplying future first length values by the new scale factor.

12. The method of claim 1, wherein the measuring and calculating is automatically performed on the printing device at predetermined intervals of processed media sheets.

13. The method of claim 1, wherein the measuring and calculating is performed during normal operation of the printing device in processing print jobs as opposed to being performed as a separate calibration process.

14. A system provided in a printing device, the system comprising:

a first means for measuring the length of a sheet of media that obtains a first length value;

a second means for measuring the length of the sheet of media that obtains a second length value, the second means being more accurate than the first means;

means for identifying error in the first means from comparison of the first length value and the second length value and for calculating a scale factor that can be applied to measurements made by the first means to compensate for the error, wherein the scale factor is calculated relative to the first and second length values; and means for applying the scale factor to later measurements made by the first means in relation to other sheets of media to improve the accuracy of those measurements.

15. The system of claim 14, wherein the first means comprises a sensing system associated with a drive roller of the printing device, the sensing system including an optical sensor used to detect leading and trailing edges of media driven by the roller and an encoder used to determine a number of revolutions of the roller that occur between detection of the leading and trailing edges.

16. The system of claim 14, wherein the second means comprises a sensing system associated with a print drum of the printing device, the sensing system including an optical sensor used to detect leading and trailing edges of media loaded onto the print drum and an encoder used to determine a number of revolutions of the print drum that occur between detection of the leading and trailing edges.

17. The system of claim 14, wherein the means for calculating a scale factor comprise means for calculating a length ratio that correlates the first length value and the second length value.

18. The system of claim 14, further comprising means for multiplying future first length values by the scale factor.

19. A printing device comprising:

a controller;

a print mechanism including a first sensing system that measures the length of media and a second sensing system that measures the length of media, the second sensing system being more accurate than the first sensing system; and memory that stores calibration logic configured to identify error in the first sensing system from comparison of a first length value measured by the first sensing system and a second length value measured by the second sensing system and to calculate a scale factor that can be applied to measurements made by the first sensing system to compensate for the error, the memory further storing size determination logic configured to apply the calculated scale factor to later measurements made by the first sensing system to improve the accuracy of those measurements.

20. The printing device of claim 19, wherein the first sensing system is associated with a drive roller of the printing device and the second sensing system is associated with a print drum of the printing device and wherein the calibration logic calculates the scale factor relative to information obtained from the first and second sensing systems.

21. The printing device of claim 20, wherein the first and second sensing systems each comprise an optical sensor used to detect leading and trailing edges of media and an encoder used to determine a number of revolutions of a printing device component that occur between detection of the leading and trailing edges.

22. The printing device of claim 20, wherein the scale factor is applied to measurements made by the first sensing system to account for wear of the drive roller that decrease the accuracy of the measurements.

23. The printing device of claim 20, wherein the calibration logic is configured to calculate a length ratio that correlates first length values obtained from the first sensing system and second length values obtained from the second sensing system.

24. The printing device of claim 20, wherein the calibration logic is configured to calculate the scale factor by multiplying the length ratio by a previous scale factor.

25. The printing device of claim 20, wherein the size determination logic is configured to multiply measurements obtained from the first sensing system by the scale factor.

* * * * *